US010470578B2

(12) United States Patent
Ehlinger

(10) Patent No.: US 10,470,578 B2
(45) Date of Patent: Nov. 12, 2019

(54) WALL MOUNTED COLLAPSIBLE CHAIR

(71) Applicant: Seth Ehlinger, Bend, OR (US)

(72) Inventor: Seth Ehlinger, Bend, OR (US)

( * ) Notice: Subject to any disclaimer, the term of this patent is extended or adjusted under 35 U.S.C. 154(b) by 76 days.

(21) Appl. No.: 15/326,319

(22) PCT Filed: Jul. 1, 2015

(86) PCT No.: PCT/US2015/038908
§ 371 (c)(1),
(2) Date: Jan. 13, 2017

(87) PCT Pub. No.: WO2016/010738
PCT Pub. Date: Jan. 21, 2016

(65) Prior Publication Data

US 2017/0188712 A1 Jul. 6, 2017

Related U.S. Application Data

(60) Provisional application No. 62/024,015, filed on Jul. 14, 2014.

(51) Int. Cl.
*A47C 9/06* (2006.01)
*A47C 4/04* (2006.01)
*A47C 7/54* (2006.01)

(52) U.S. Cl.
CPC ..... *A47C 9/06* (2013.01); *A47C 4/04* (2013.01); *A47C 7/543* (2013.01)

(58) Field of Classification Search
CPC .. A47C 9/06; A47C 4/52; A47C 1/126; A47C 4/04; A47C 4/46; A47C 7/008; A47C 7/543; A47C 4/283; B64D 11/06; B64D 11/0649; B64D 11/0691
USPC ..... 297/19, 14, 129, 54, 42, 337
See application file for complete search history.

(56) References Cited

U.S. PATENT DOCUMENTS

| | | | | | |
|---|---|---|---|---|---|
| 2,497,412 | A * | 2/1950 | Larin | A47C 9/06 | 114/188 |
| 3,594,037 | A * | 7/1971 | Sherman | A47C 1/036 | 297/14 |
| 6,343,834 | B1 * | 2/2002 | Wurmlinger | A47C 9/06 | 108/134 |
| 6,896,322 | B1 * | 5/2005 | Foy | A47C 1/126 | 297/129 |
| 7,367,616 | B2 * | 5/2008 | Summerford | A47C 9/06 | 297/14 |
| 9,340,293 | B2 * | 5/2016 | Guering | B64D 11/06 | |
| 9,688,168 | B2 * | 6/2017 | Gratz | B60N 2/309 | |
| 9,848,708 | B2 * | 12/2017 | Windsor | A47C 7/14 | |
| 9,856,024 | B2 * | 1/2018 | Burd | B64D 11/06 | |
| 2003/0160145 | A1 * | 8/2003 | Prior | A47B 85/00 | 248/461 |
| 2007/0251165 | A1 * | 11/2007 | Kern | A47C 17/52 | 52/173.1 |
| 2011/0088163 | A1 * | 4/2011 | Luft-Weissberg | A47B 83/00 | 5/2.1 |
| 2013/0175836 | A1 * | 7/2013 | Chen | A47C 1/0342 | 297/273 |

* cited by examiner

*Primary Examiner* — Chi Q Nguyen
(74) *Attorney, Agent, or Firm* — Leber IP Law; Celia H. Leber

(57) ABSTRACT

Foldable seating assemblies are disclosed. The seating assemblies are configured to be mounted on a vertical surface, and to be stowed in an unobtrusive manner when not in use.

23 Claims, 18 Drawing Sheets

WALL MOUNTED COLLAPSIBLE CHAIR

BACKGROUND

The invention relates to a wall-mounted collapsible chair. More particularly it relates to chairs of the general type adapted for periodic use in areas of limited space, which may be collapsed to clear space so that the seat or support structures do not obstruct movement.

Wall-mounted, fold-down chairs are well known in the prior art. Such chairs have found use both in stationary and movable dwelling structures such as trains, hospitals, washrooms and other facilities where free space can be limited.

SUMMARY

Generally, this invention relates to chairs to be mounted on vertical surfaces, e.g. walls or the like, which are collapsible to allow for convenient, unobtrusive storage when not in use.

In one aspect, the invention features a folding seat for mounting on a vertical surface comprising a frame for mounting on a vertical surface, a plurality of leg members that are pivotably mounted to the frame and are configured to be fully recessed in the frame when the folding seat is in a closed position, and a seat element that is pivotably mounted to the frame and also to the leg members and is configured to be fully recessed in the frame when closed.

Some implementations include one or more of the following features.

The folding seat further comprises a backrest that is pivotably mounted to a crossbar that connects the leg members. The backrest can be configured to articulate. The backrest may be configured with flexible portions.

The leg elements may be pivotably mounted in the middle third of opposing side edges of the seat element. The leg elements may be pivotably mounted substantially in the middle of the opposing side edges of the seat element. The leg members may have upper ends that are configured to be vertically slidable with respect to the frame. The leg members may extend diagonally from the vertical surface to a supporting horizontal surface when deployed. The leg members may be configured with leveling elements. The leveling elements could be fixedly adjusted.

A slide bar may be configured to connect the upper ends of the leg members. The slide bar may be unsupported from below when the device is deployed.

A pair of armrests may be pivotably attached to the seat support members. The armrests may be configured to automatically retract in a coordinated manner with the retraction of the seat.

A wall-mounting bracket may be configured to interact with the frame and be securely affixed to the vertical surface.

The folding seat may further comprise paneling attached to the frame. The folding seat may further comprise cover elements that are attached to the outer aspects of the frame, seat element, armrests, and leg members. The cover elements may be configured to substantially mesh together to form a substantially uniform surface that is exposed when the folding seat is in its closed position.

The folding seat may further comprise a handle configured to allow a user to deploy the folding seat.

Friction hinges may be used to pivotably mount the seat element to the frame.

In another aspect, the invention features a folding seat for mounting on a vertical surface, the folding seat comprising a frame for mounting on a vertical surface, a seat element that is pivotably mounted to the frame, and a plurality of leg members that are pivotably mounted to the frame and pivotably mounted to the seat element, wherein the leg members are mounted in the middle third of opposing edges of the seat member.

In another aspect, the invention features a folding seat for mounting on a vertical surface comprising a frame for mounting on a vertical surface, a seat element that is pivotably mounted to the frame, and a plurality of leg members that are pivotably mounted to the frame and pivotably mounted to the seat element, wherein the upper ends of the leg members are unsupported from below and press against the vertical surface in response to a force exerted on the lower ends of the leg elements by a supporting horizontal surface.

In another aspect, the invention features a folding seat for mounting on a vertical surface comprising a frame for mounting on a vertical surface, a seat element that is pivotably mounted to the frame, a plurality of leg members that are pivotably mounted to the frame and pivotably mounted to the seat element, and a backrest that is pivotably mounted to the upper ends of the leg members.

These aspects of the invention may include any one or more of the features discussed above with regard to the first aspect of the invention.

DETAILED DESCRIPTION

The present disclosure relates to collapsible chairs that may be mounted on a vertical surface, such as a wall, e.g. a bathroom wall. Because the chairs are collapsible they may be quickly and easily deployed when needed or retracted when not in use.

Figure 1:
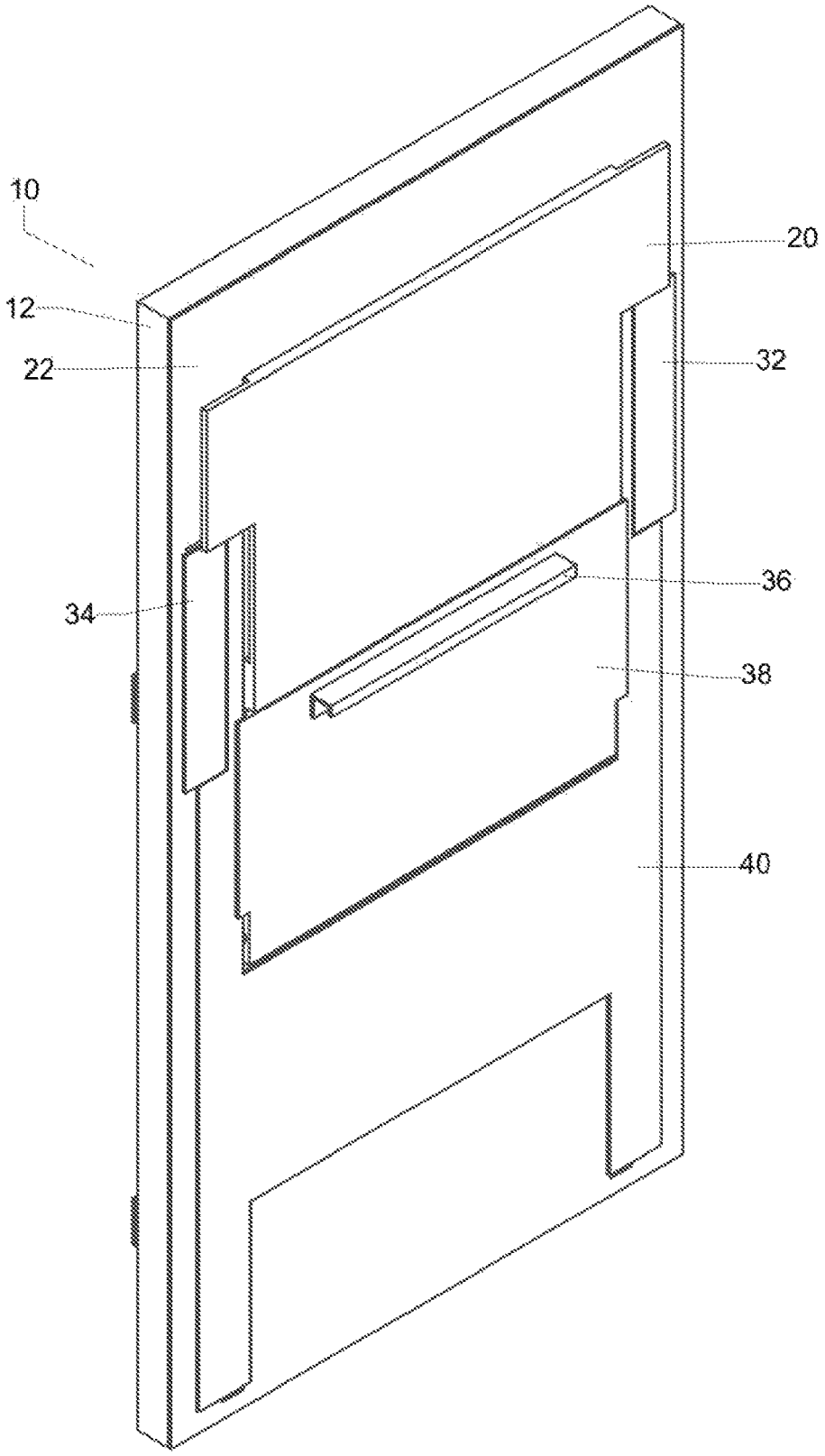
FIG. 1 is a perspective view of a device according to one implementation, shown in a closed or stowed position.

Referring to FIG. 1, in one implementation the device 10 has a frame 12. Outer surface 22 is attached to frame 12. When in the closed position, as shown in FIG. 1, backrest 20, armrest surfaces 32, 34, leg-element cover 40 and seat cover 38 are configured to integrate or nest together so that they form a substantially uniform planar surface which is substantially flush with outer surface 22. For example, in preferred implementations when the device is in its closed position no part of the device extends more than 25 mm beyond the surface of outer surface 22, and preferably no part of the device extends more than 15 mm beyond the outer surface 22. Handle 36 is attached to seat cover 38 and provides an interface point for the user to actuate the device into the open position shown in FIG. 3.

Figure 4:
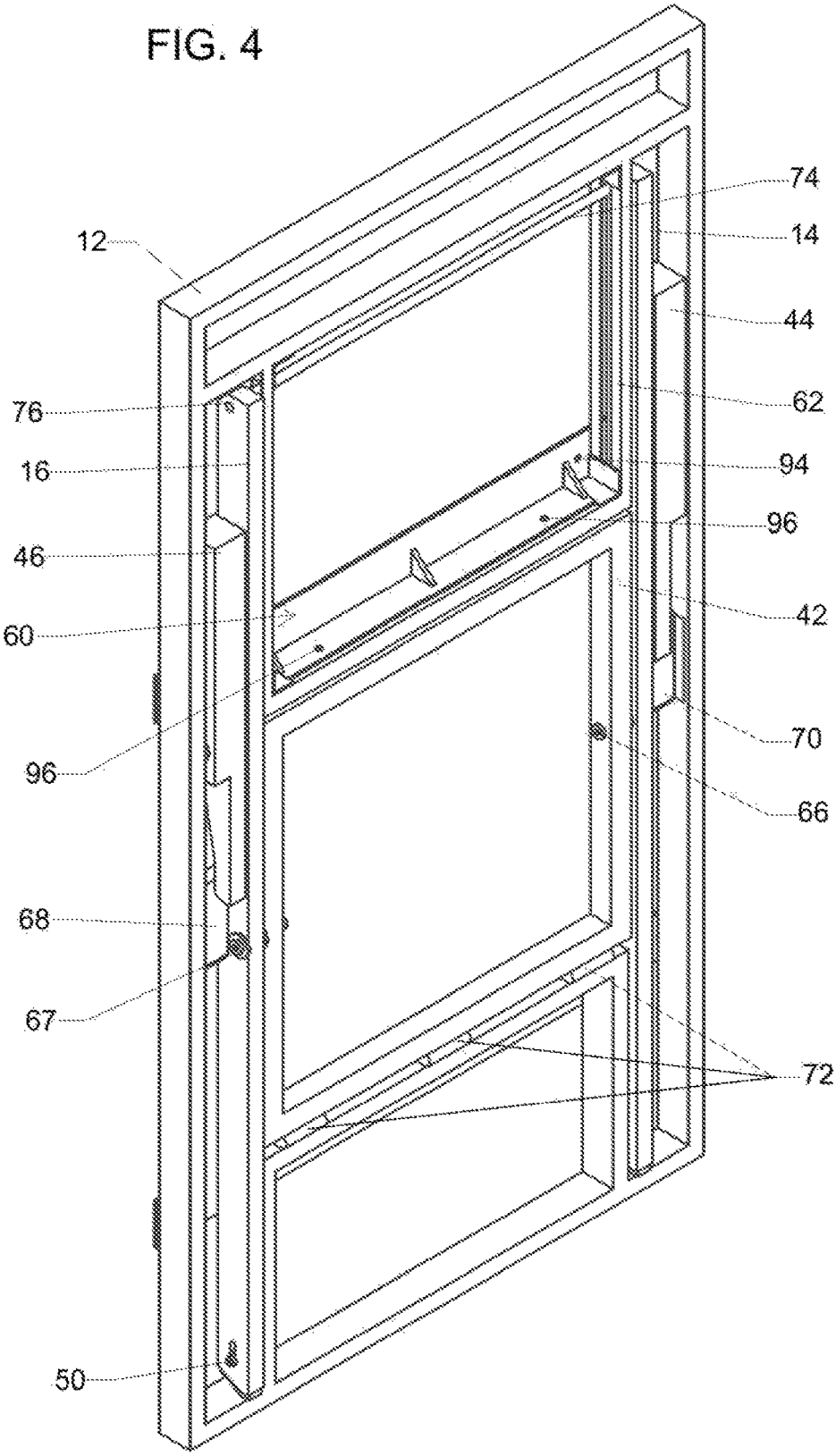
FIG. 4 is a perspective view of the device in the closed position with the outer surfaces removed.
Figure 5:
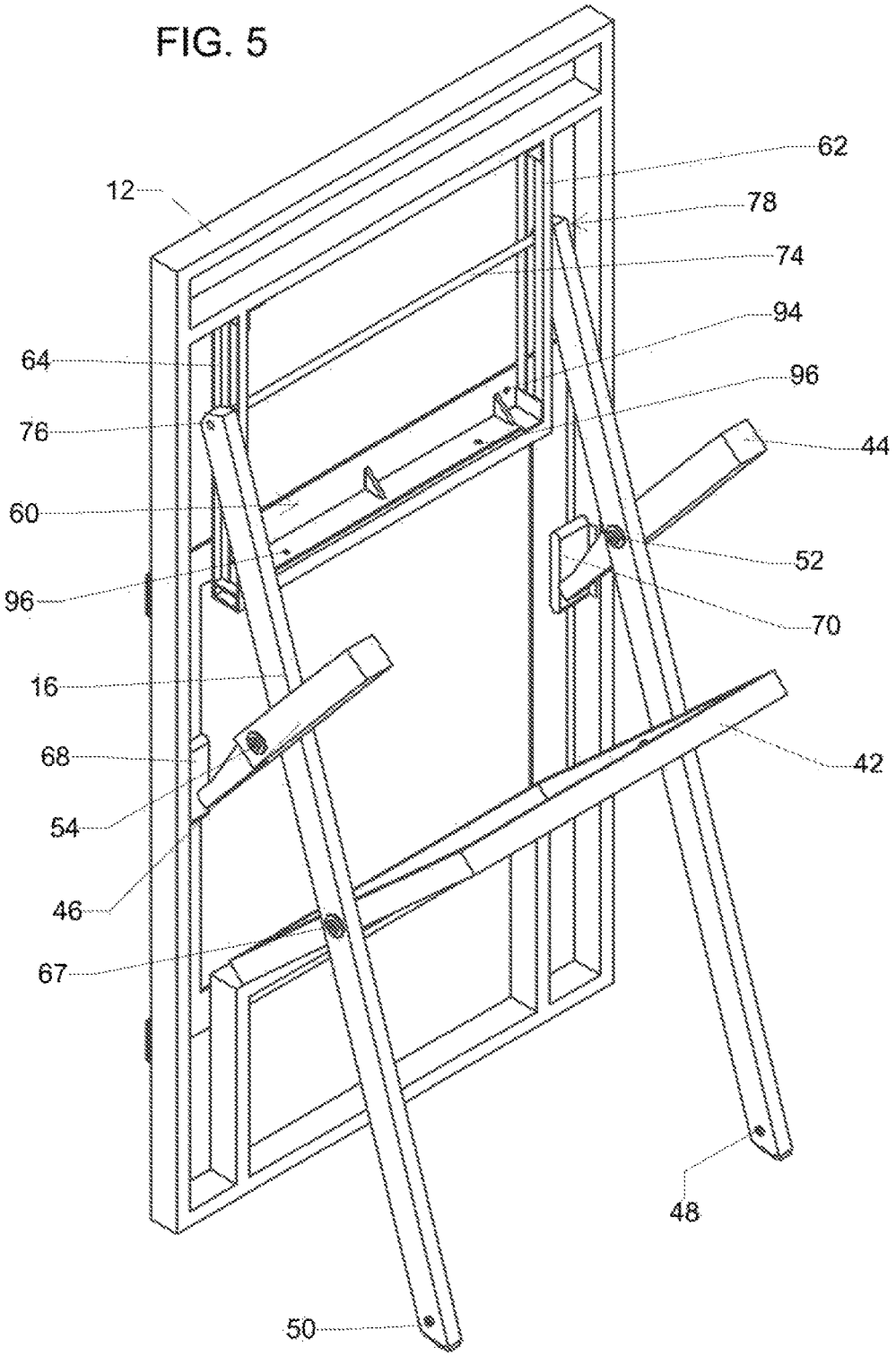
FIG. 5 is a perspective view of the device in a partially open position with the outer surfaces removed.
Figure 6:
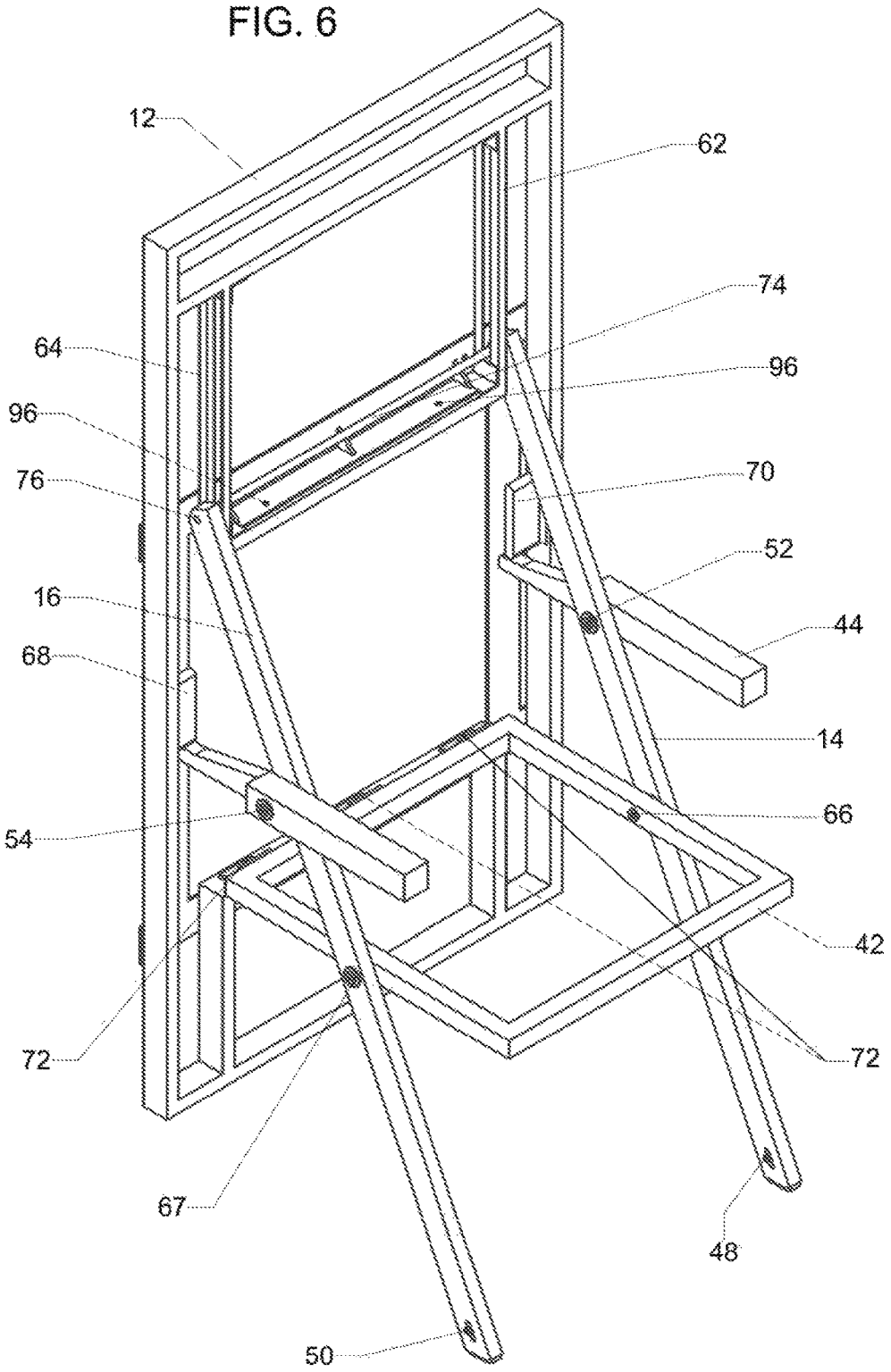
FIG. 6 is a perspective view of the device in the fully open position with the outer surfaces removed.

The surface elements discussed above are mounted to an underlying structure shown in FIGS. 4-6. Thus, the leg-element cover 40 is mounted to the front surfaces of a pair of leg elements 14, 16 (best seen in FIG. 5), while the seat cover 38 (FIG. 1) is mounted to the top surface of a seat frame 42 (FIG. 5). Armrest surfaces 32, 34 are mounted on planar surfaces of armrest supports 44, 46.

Figure 3A:
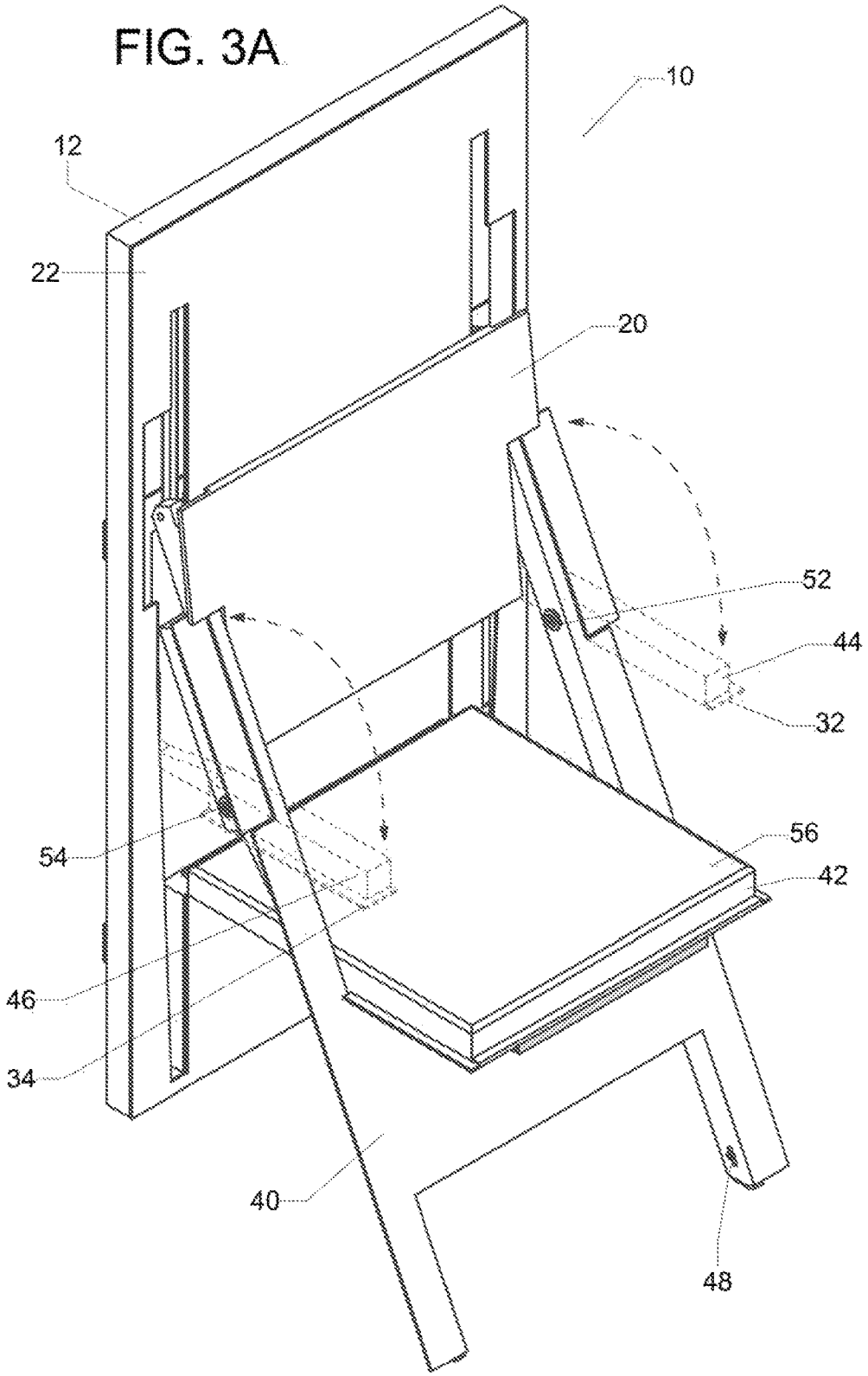
FIG. 3A is a perspective view of the device in a fully open position.
Figure 10:
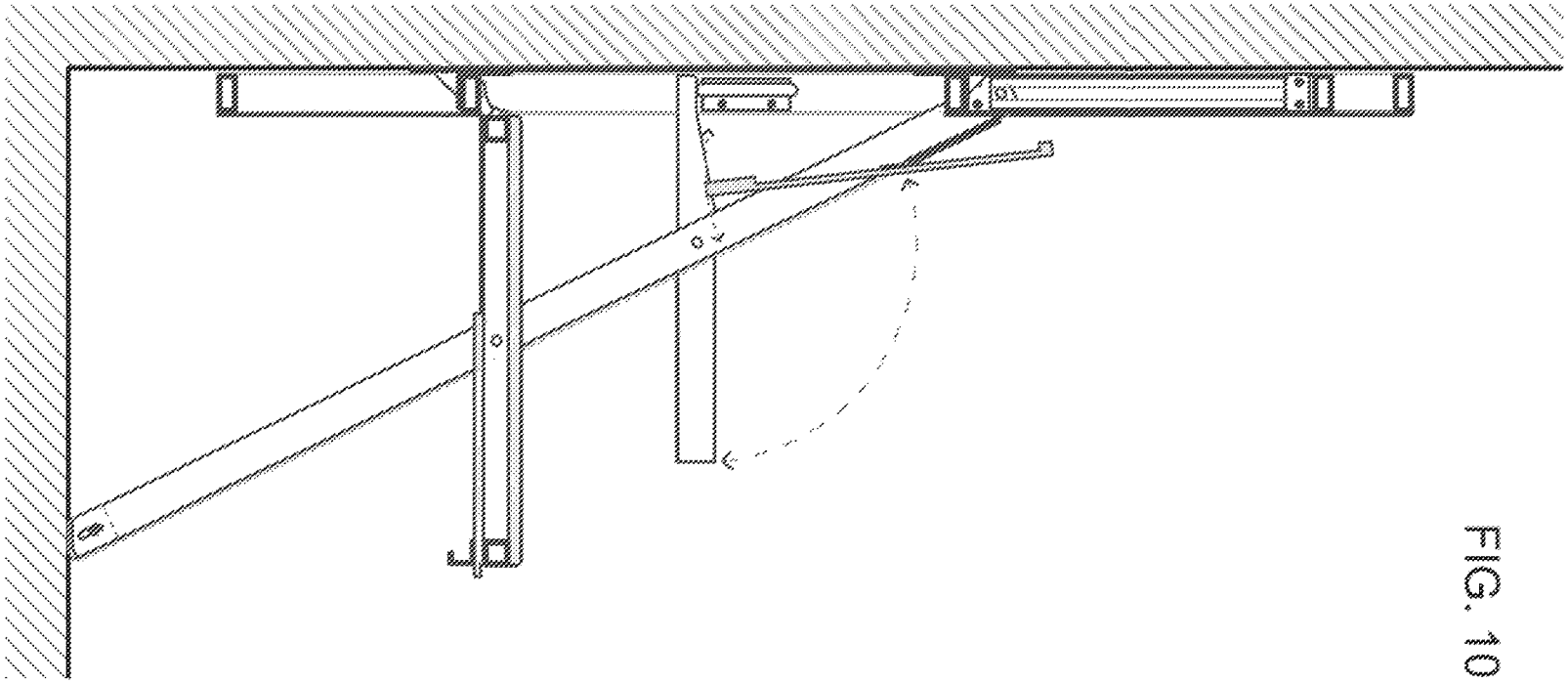
FIG. 10 is a side sectional view of the device in a fully open position.

Referring to FIG. 3A, backrest 20 is pivotably mounted to crossbar 86 by hinges 82, 84. Crossbar 86 extends laterally between leg elements 14, 16 and is securely mounted to the upper portion of each leg element. Hinges 82, 84 allow articulation of the backrest when the device is deployed and/or retracted as seen in FIG. 10. When the device is deployed, the articulation (or pivoting action) of backrest 20 provides a more comfortable surface to lean back against when a person is seated. Preferably, hinges 82, 84 are a friction hinges or a similar mechanical, pivoting mechanism that minimizes uncontrolled motion of the backrest 20. Friction hinges are well known in the art. The amount of friction of such hinges can be adjusted to accommodate the intended application.

Figure 3B:
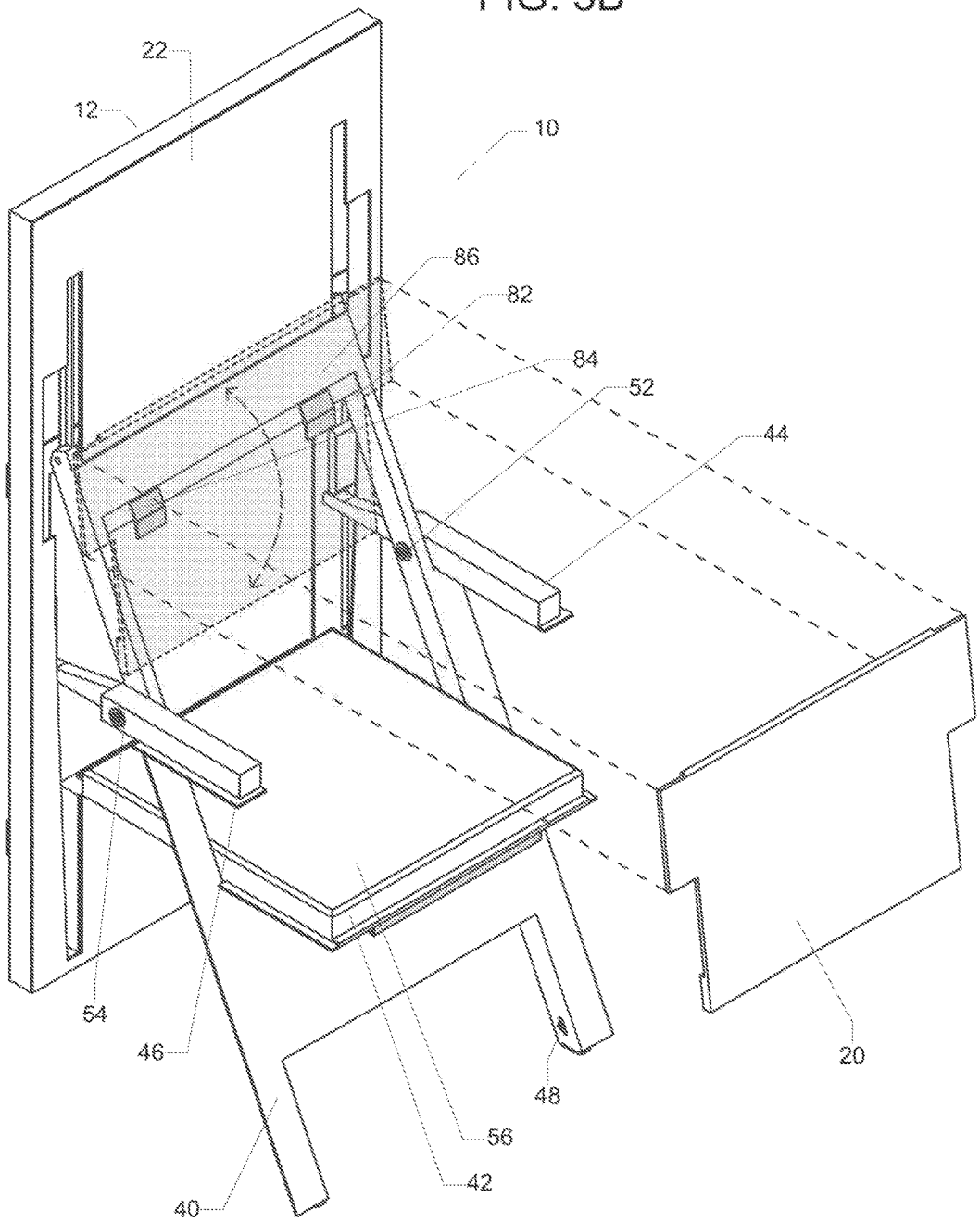
FIG. 3B is a perspective view of the device with the backrest exploded off the device.
Figure 3C:
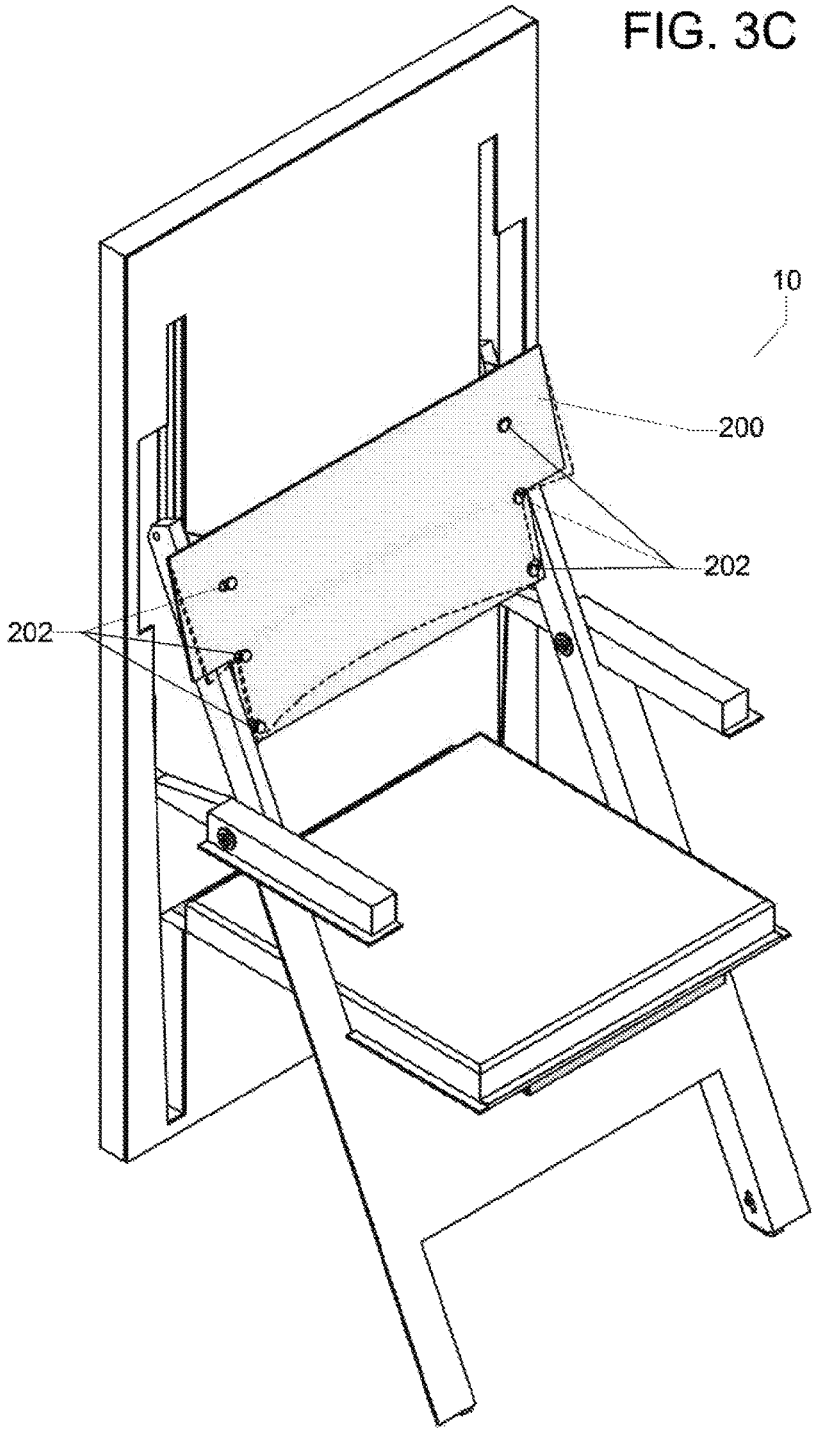
FIG. 3C is a perspective view of an alternate embodiment of the seatback.

As seen in FIGS. 3A and 3B, the backrest 20 is configured to allow flex to accommodate the contours of a person's back thereby increasing the comfort for the user. For instance, referring to FIG. 3C, the backrest could have notches or flexible areas 202 that would allow the surface to deflect and conform to a person's back.

Figure 2:
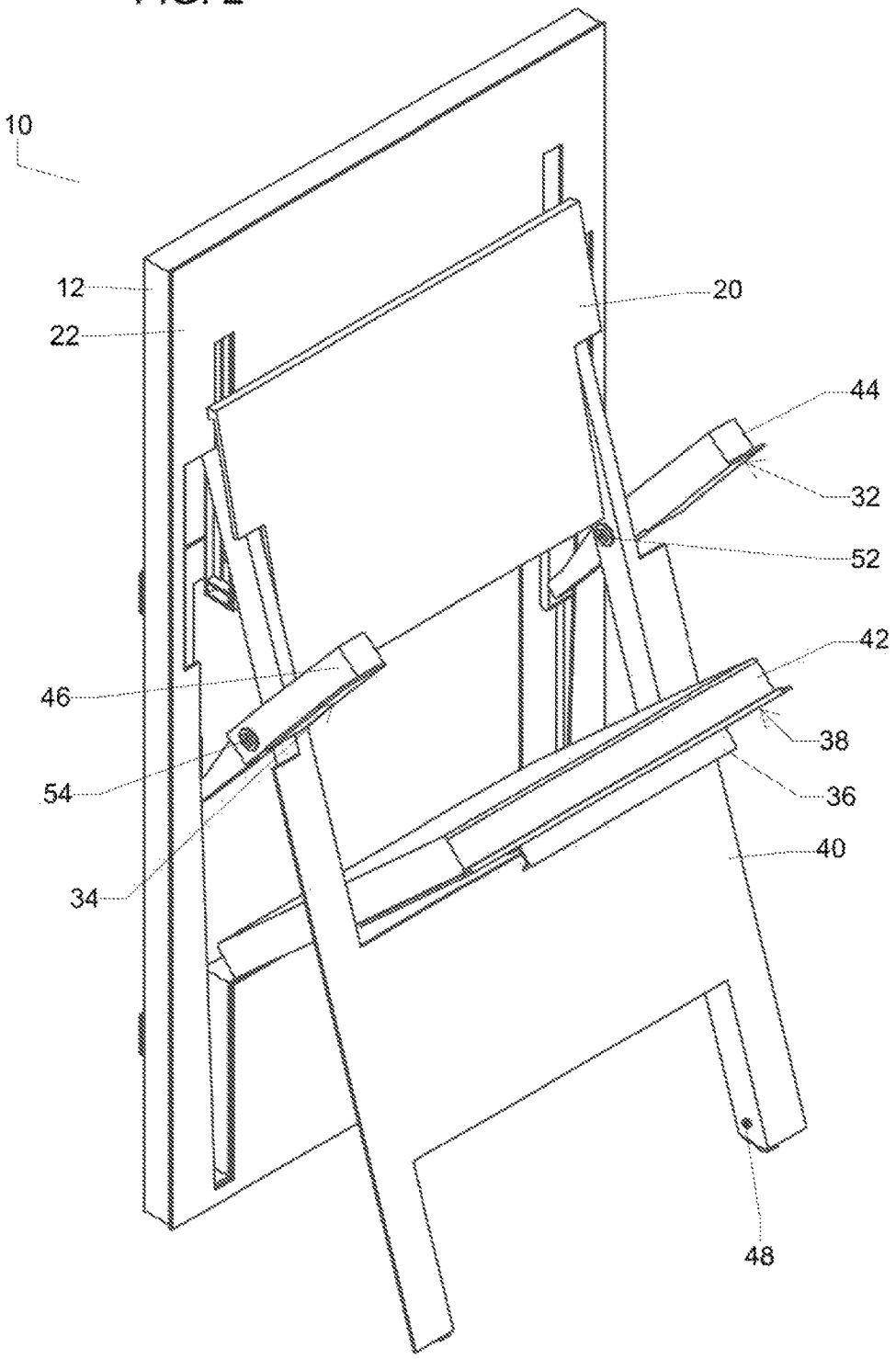
FIG. 2 is a perspective view of the device of FIG. 1 in a partially open position.

Referring to FIGS. 2, 3A and 3B, when the device 10 is deployed into the open position a seating surface 56 (mounted on the opposite surface of the seating surface frame from the seat surface 38), the armrest supports 44, 46 and the backrest 20 are exposed and available for use.

Referring to FIGS. 4-6, when the device is closed, leg elements 14, 16, seat frame 42 and armrest elements 44, 46 are configured to be fully received inside frame 12.

Seat frame 42 is pivotably attached to leg elements 14, 16 at seat pivot points 66, 67 and to a horizontal member 80 of frame 12 at hinge points 72 (FIG. 4). Hinge points 72 are preferably friction hinges that allow for controlled movement. Friction hinges are well known in the art and can easily be adjusted to provide sufficient resistance to ensure that the device will not deploy in an uncontrolled, haphazard manner.

Pivot points 66, 67 are located on opposing sides of seat frame 42, preferably substantially in the center, i.e., within 20 mm of the center, preferably within 10 mm, and most preferably within 5 mm of the center, of each side member of the seat frame 42. While central mounting is generally preferred for optimal force distribution, pivot points 66, 67 could alternatively be located in the middle third of seat frame 42 or within about 8 cm of the center of seat frame 42 on either side.

Leg elements 14, 16 are pivotably connected to a slide bar 74 at pivot points 76, 78. When deploying the device from the closed position to the open position, slide bar 74 moves vertically within slide bar guides 62, 64 and consequently provides coordinated movement of leg elements 14, 16.

As the leg elements slide downward, they also pivot outwardly about pivot points 76, 78, such that when the chair is in its open position the leg elements extend diagonally away from the frame to contact the floor. Due to the connection between the seat frame and the leg elements at pivot points 66, 67, downward movement of the leg elements pivots causes the seat to pivot about the hinge points 72, moving the seat out of the frame to a deployed position in which seat surface 56 is exposed for use.

The downward movement of the slide bar 74 is only limited by the leg elements making contact with the floor, as there are no stops in the slide bar guides to limit movement. As a result, the slide bar 74 is not supported from below when the device is fully deployed. The distal end of each of the leg elements has an angled surface, as shown in FIG. 10, so that the leg element has a bearing surface in contact with the floor.

Figure 11:
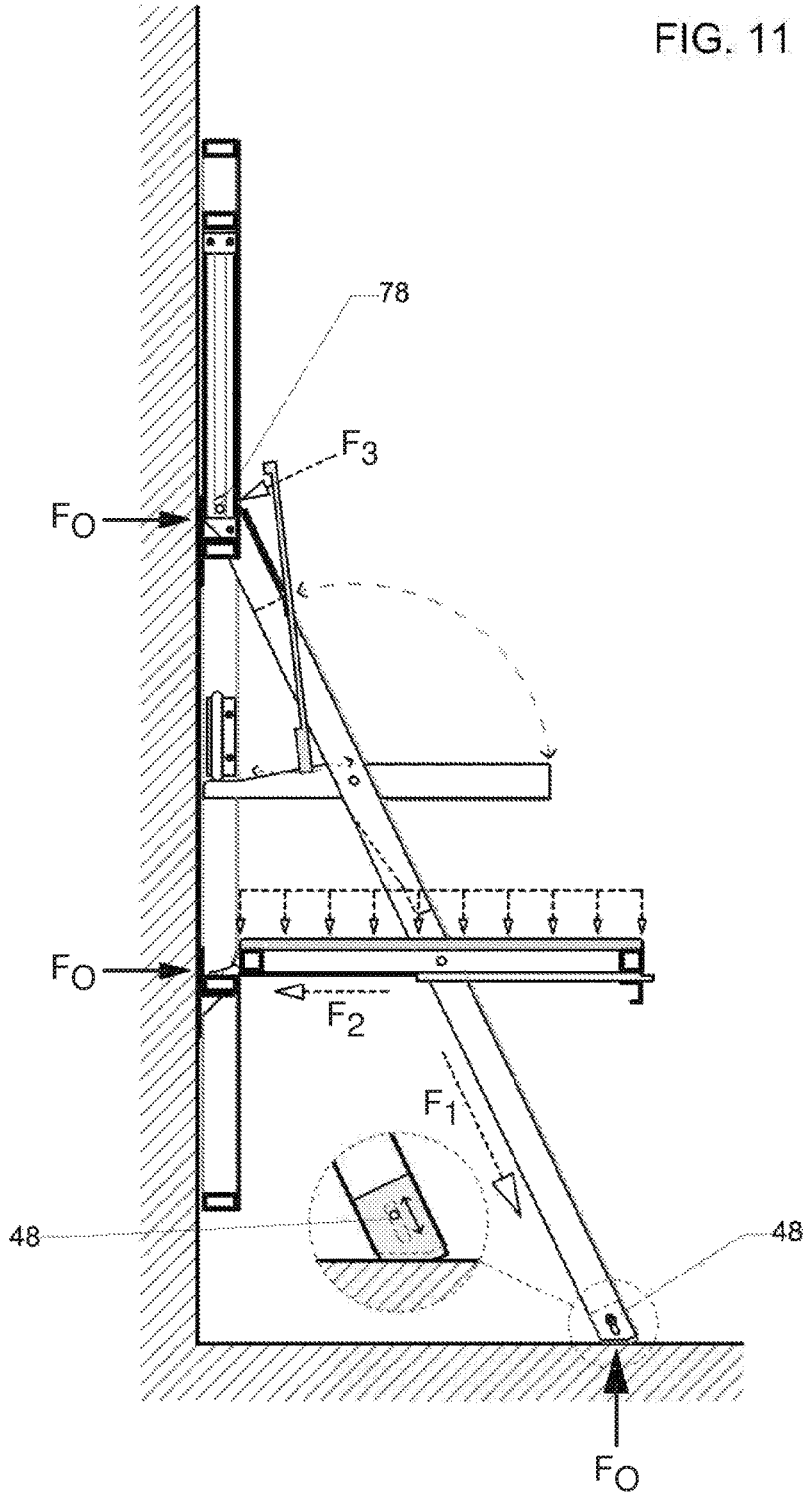
FIG. 11 is a side sectional diagrammatic view of the device in the fully open position, shown with force vectors indicating the applied forces and reactive forces when weight is placed on the chair seat.

Because the slide bar 74 is unsupported from below when the device is deployed, the leg elements do not hang from the frame when a force is applied to the seat during use (FIG. 11). Instead, force transmitted from the seat downward through the leg elements to the floor results in a reactive force upward through the leg elements that exerts a compressive force against the wall at the upper ends of the leg elements. This compressive force is applied generally perpendicular to the surface of the wall, further minimizing the load applied to the mechanical fasteners that attach the device to the wall. If, instead, the downward vertical movement of the slide bar were limited prior to contact of the leg elements with the floor, the leg elements would become tension members, hanging from the slide bar and taking most of the downward forces when a user is seated in the chair. This would cause lateral forces to be exerted on the wall, which could result in wall fastener failure and dismounting of the device from the wall.

Because the leg elements 14, 16 extend from the floor to the wall when the chair is deployed, reactive forces applied to the leg elements by the floor are transmitted to the wall as generally horizontal forces. These forces are distributed between two points (the seat frame hinge points 72 and the pivot points 76, 78.) as shown in FIG. 11. This force distribution increases chair stability and minimizes torsional forces that would tend to lever the device off of the wall.

Referring to FIG. 6, the armrests can be left in the stowed position or deployed as needed by the user. The armrest elements 44, 46 pivot about pivot points 52, 54. Bearing elements 68, 70 help automatically guide the armrest elements 44, 46 to the appropriate stowed orientation in a coordinated fashion as the chair is closing.

The device can be installed and utilized without making substantial structural improvements to existing walls. Referring to FIG. 11, the forces applied to the device by the seated user are represented by dashed, open lines and the corresponding opposing forces ($F_O$) in solid, closed lines. As shown in FIG. 11, the downward force applied by a user to the chair seat (small vertical arrows) is transferred, via pivot points 67, 66, to the leg elements 14, 16 and through the leg elements to the floor surface (force $F_1$). A relatively small amount of force (force $F_2$) is applied through the seat horizontally into the wall, and through the upper pivot points 76, 78 to the wall (force $F_3$), but the majority of the force is applied to the floor. Thus, there is little (if any) tendency for the device 10 to be levered off of the wall surface even when a relatively heavy person is seated. As a result, the device can generally be mounted to the wall without the need for structural anchors or modification to the wall.

Figure 7:
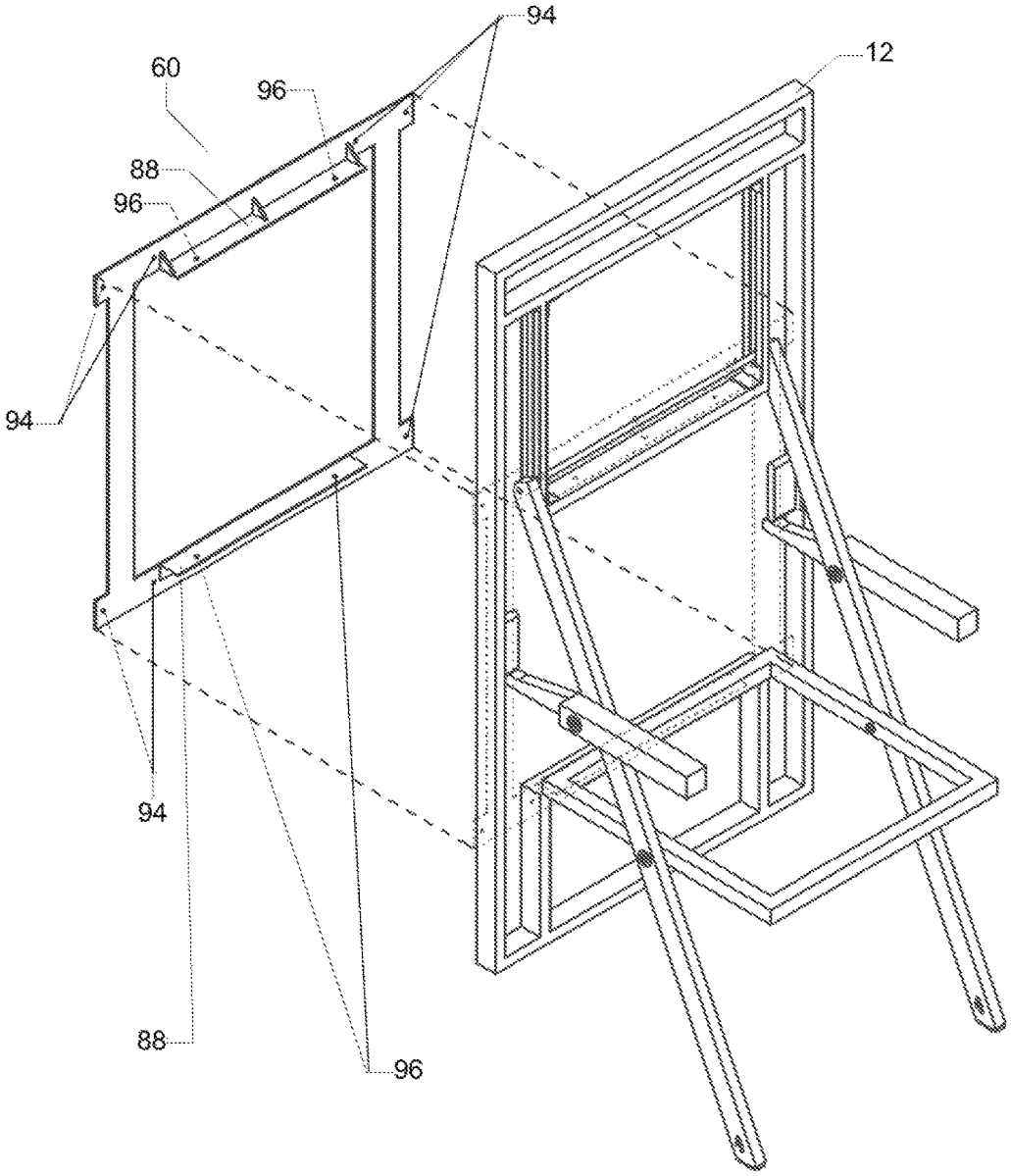
FIG. 7 is a partially exploded, perspective view of the device in the fully open position with the outer surfaces removed with the frame exploded from the mounting bracket.

Referring to FIGS. 4 and 7, a mounting bracket 60 is configured to interface with frame element 12 to securely mount the device on a horizontal surface, e.g. a wall. After properly aligning, leveling and securing the mounting bracket 60 on the wall, frame 12 securely engages the mounting bracket 60. Mechanical fasteners or other means can be utilized to securely affix the frame 12 to the mounting bracket 60 and similarly the mounting bracket to the vertical surface. The use of a separate mounting bracket 60 allows the user to easily align, level and secure the relatively light and maneuverable bracket during installation, rather than having to manage the weight of the entire device 10 during these steps. Wall-mounting holes 94 are provided in the vertical portion 87 of mounting bracket 60 at standardized dimensions, e.g. 16 inch and 24 inch intervals, to allow the user to easily align the mounting bracket with typical wall stud spacing intervals. Bracket-mounting holes 96 are disposed on horizontal portion 88 of mounting bracket 60. Horizontal portion 88 is disposed substantially perpendicular to vertical portion 87. This configuration allows horizontal portion 88 to engage frame 12 at predetermined locations. However, if desired, mounting bracket 60 can be omitted or integrated with frame element 12.

Figure 8:
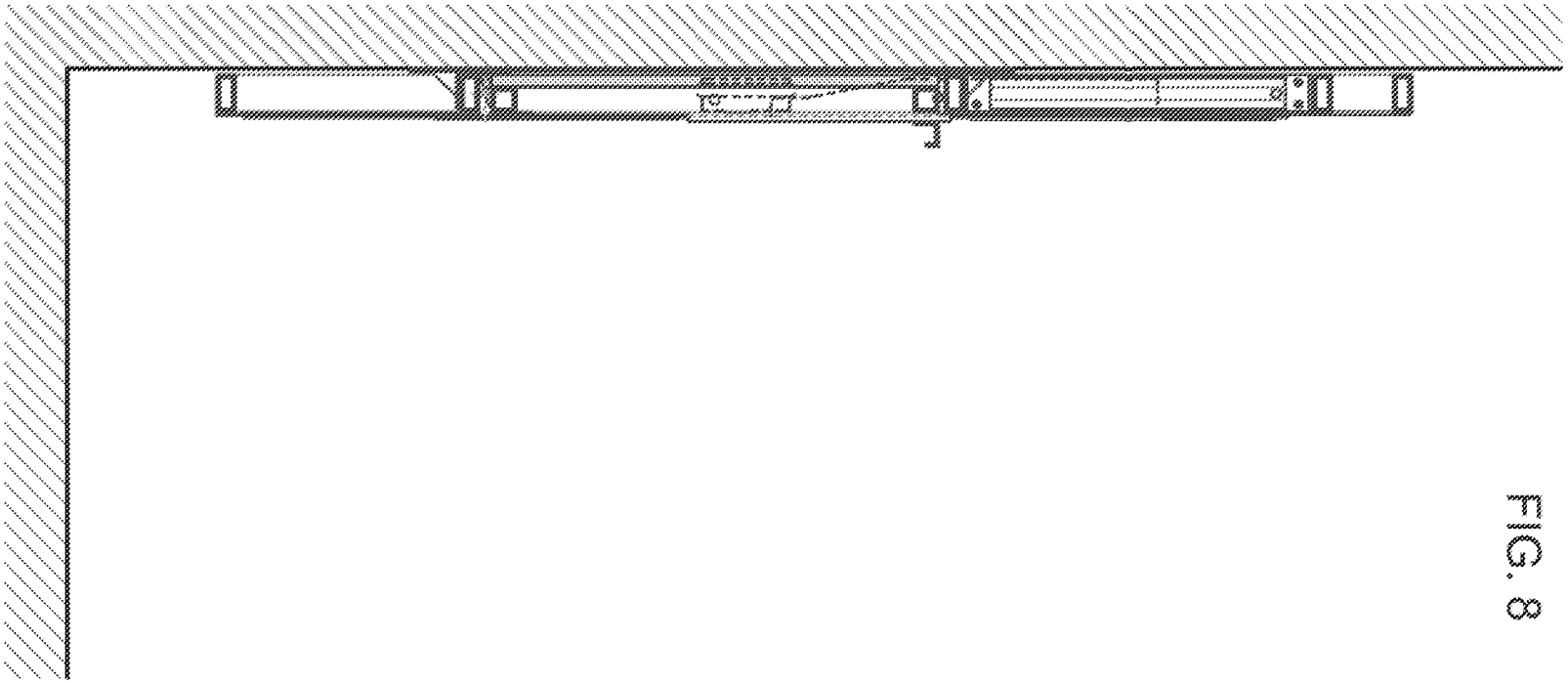
FIG. 8 is a side sectional view of the device in the closed position.
Figure 9:
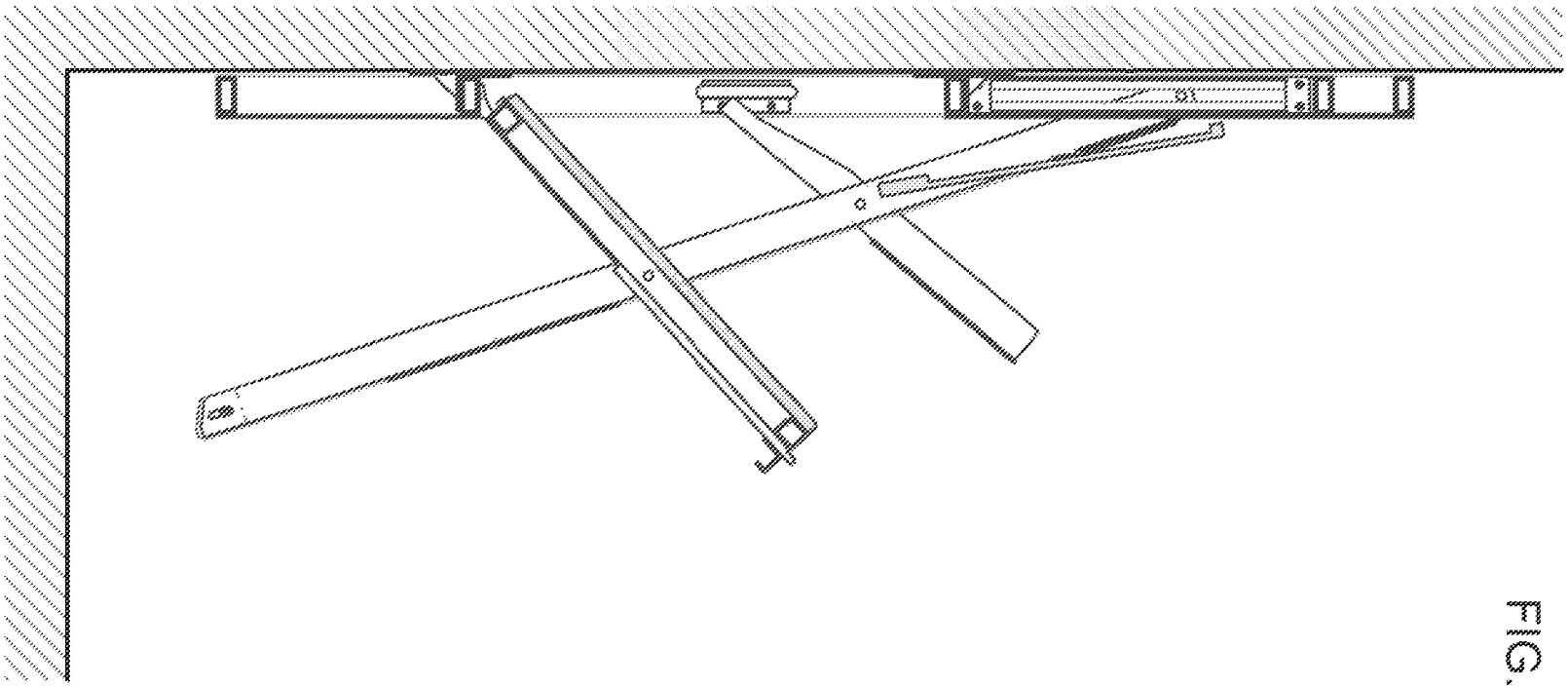
FIG. 9 is a side sectional view of the device in a partially open position.

As seen in FIG. 8, the device 10 is attached to the vertical surface in a manner such that the seating enclosure is suspended some distance above the floor. This configuration, advantageously, allows for easy, unencumbered floor cleaning, e.g. mopping, as is frequently and regularly performed in bathrooms. Leveling elements 48, 50 are independently adjustable and allow for accommodation of uneven floor surfaces ensuring a level seating surface, e.g. a seating surface that is not unduly slanted, ensuring maximum stability of the device when deployed. During initial installation of the device, leveling elements 48, 50 can be fixedly secured in place by setscrews or equivalent mechanical fixation thereby assuring that the leveling elements will not need to be readjusted upon subsequent device deployment.

The device can be constructed of a variety of materials such as metals, metal alloys, wood, plastics, or any combination thereof so long as the structural requirements of the device are met. For some applications, preferred materials will be selected to meet sanitation requirements. In some embodiments, the body-contacting portions of the seat and/or the backrest are formed of a plastic sheet material, to provide some contouring flex for user comfort.

OTHER EMBODIMENTS

A number of embodiments have been described. Nevertheless, it will be understood that various modifications may be made without departing from the spirit and scope of the disclosure.

Figure 12:
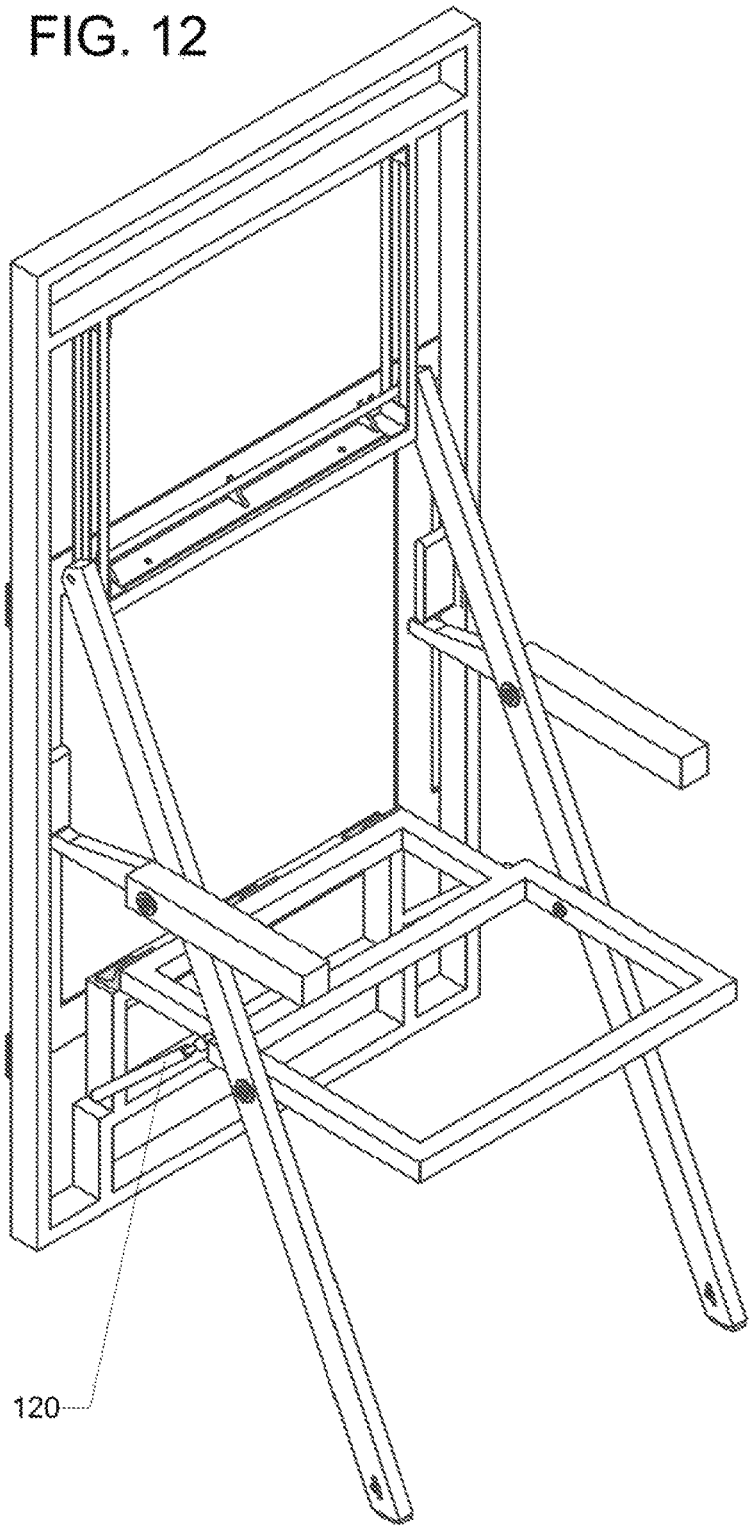
FIG. 12 is a perspective view of an alternate embodiment of the device.
Figure 13:
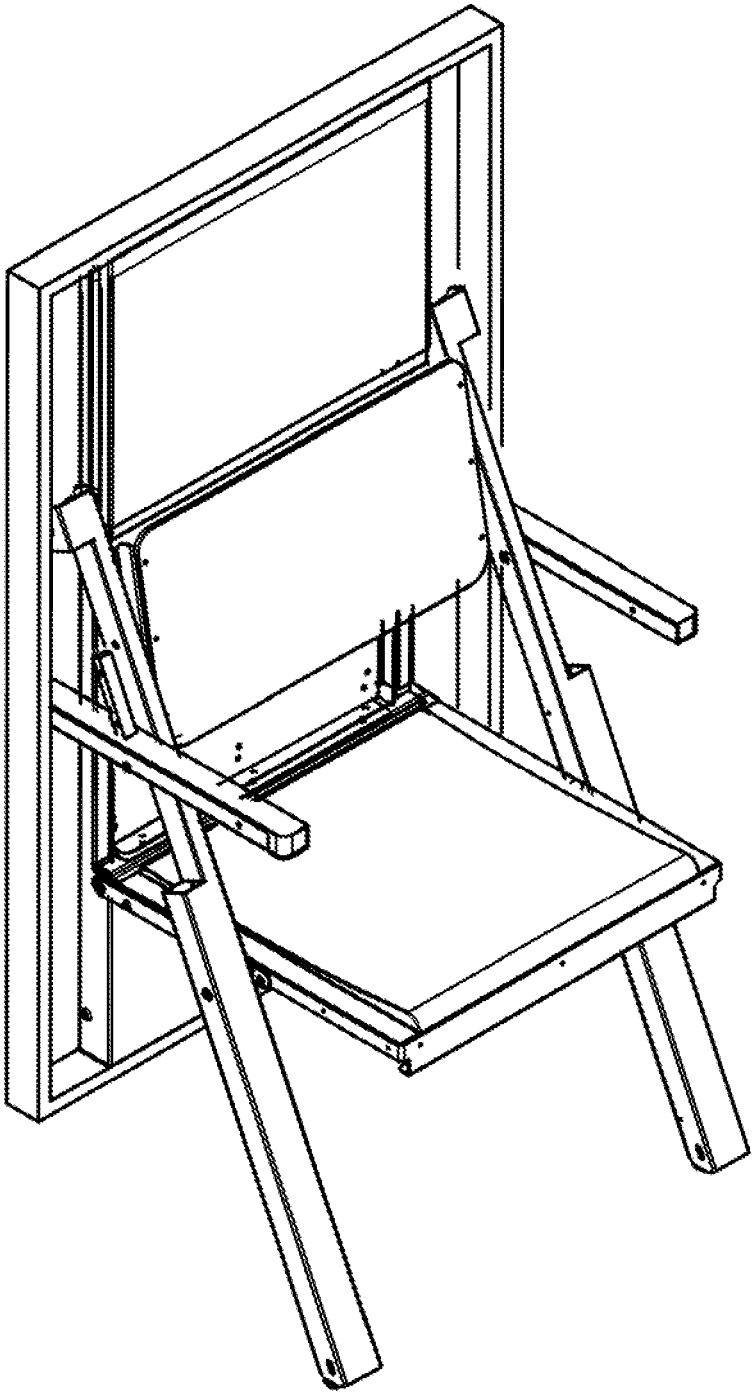
FIG. 13 is a perspective view of another alternate embodiment of the device, shown in an open position.

For example, in some embodiments the chair may include control features that would slow the movement of the device during either or both closing or opening the device, allowing for "soft" opening and/or closing. For example as seen in FIG. 12 control element 120, a gas shock, rotational damper, or other control device, is configured to offset the weight of the chair aiding the closure of the chair. In addition, the control feature would enable the user to easily initiate the opening or closing of the chair, e.g., in some embodiments with one hand or with hands full, and then the control feature would assume movement control thereby eliminating the need for further user input.

Figure 14:
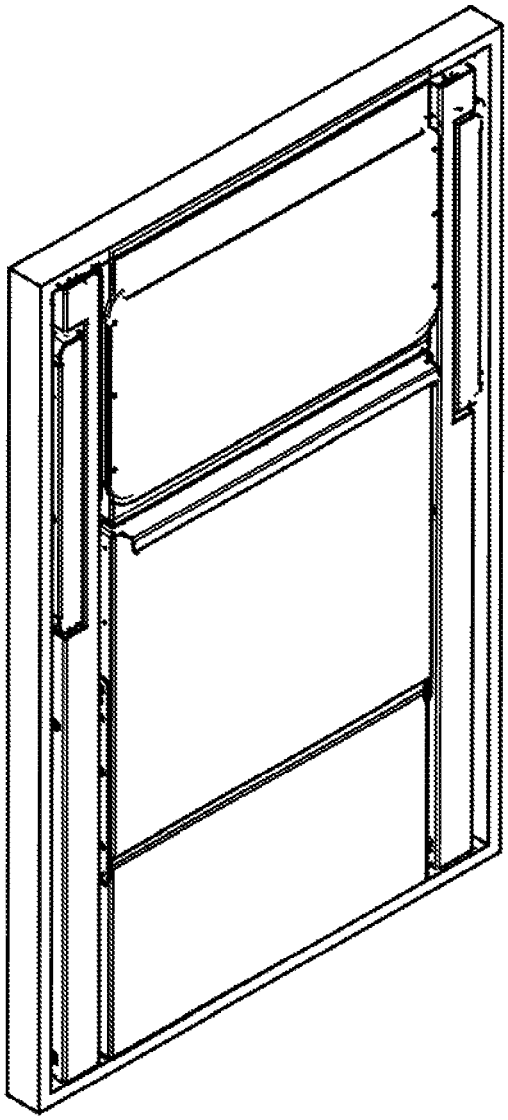
FIG. 14 is a perspective view of the device of FIG. 13, shown in a closed position.
Figure 15:
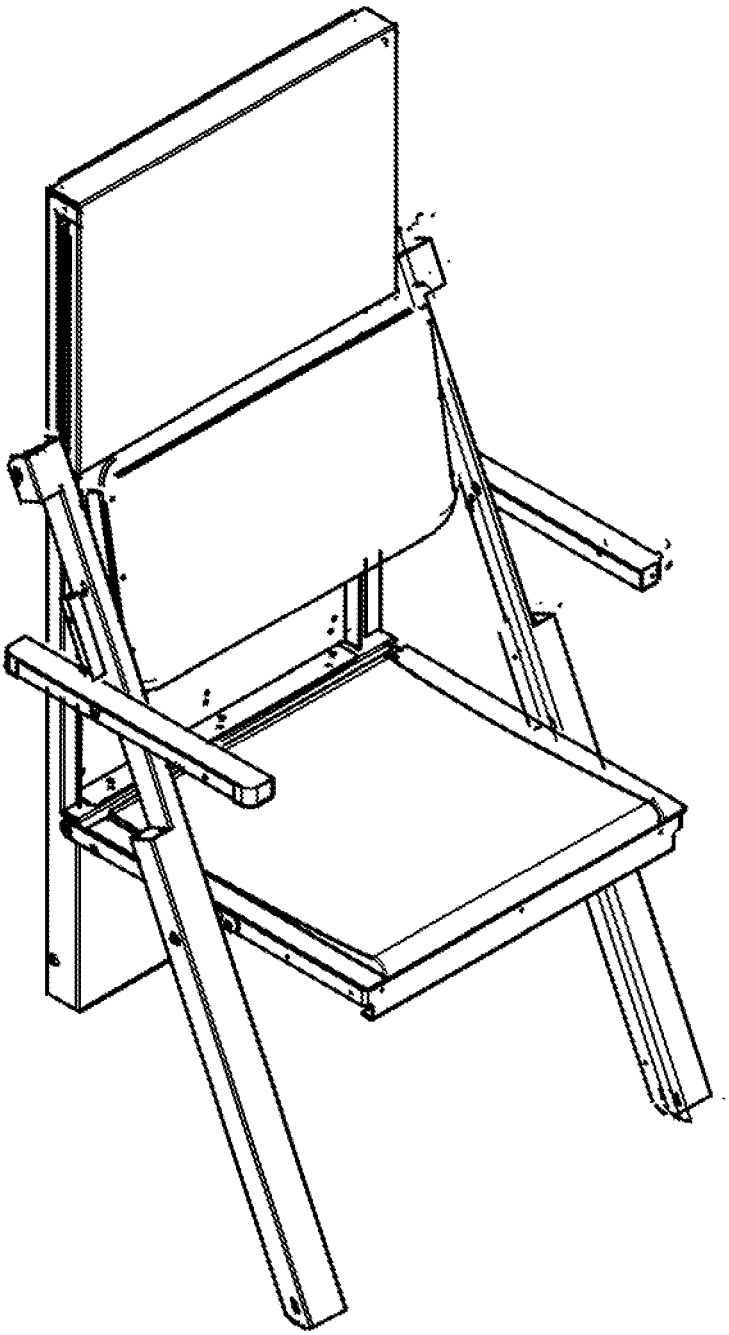
FIGS. 15 and 16 are perspective views of the device of FIG. 13 with its outer frame removed, in open and closed positions respectively.
Figure 16:
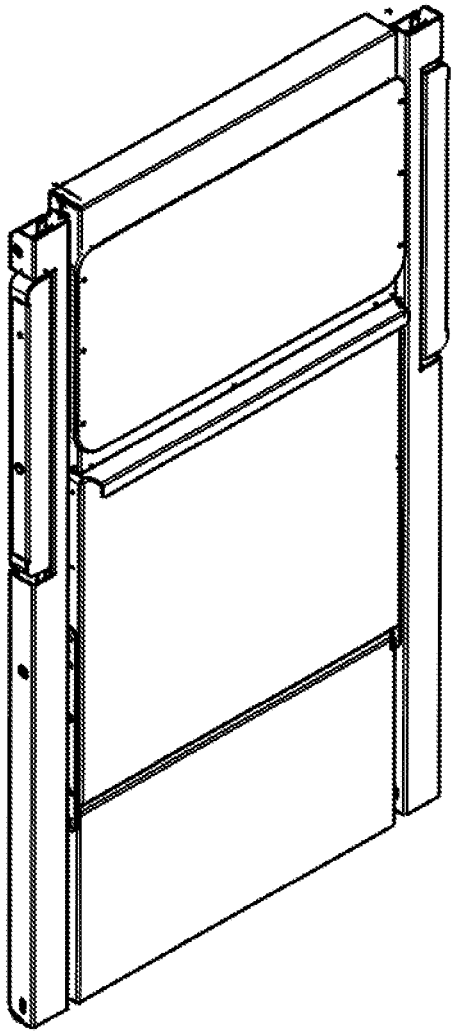

Other embodiments of the invention could feature alternatively dimensioned surfaces and elements. For example, the device could be scaled to a bench configuration that could accommodate a plurality of users at one time. Moreover, decorative elements, such as the leg-element cover 40, can be omitted, for example as in the simplified embodiments shown in FIGS. 13-16. The outer portion of frame 12, that encloses the leg elements 14, 16 (see e.g., FIG. 6), can also be omitted, for example as in the embodiment shown in FIGS. 14-16. In this case, the leg elements fold up into the plane of the internal frame components, e.g., the slide bar guides and mounting bracket.

An alternate embodiment could feature differently configured sliding guide elements that functionally mimic the slide bar and slide bar guides previously mentioned but may either provide manufacturing advantages or other functional advantages. For example, in some cases the slide bar may be omitted and the upper ends of the leg members provided with fasteners configured to engage the slide bar guides, or the slide bar and slide bar guides may be replaced with a drawer slide or the like.

Furthermore, another embodiment could feature a handle that is integrated into the seat surface. For example, the handle could be molded, co-molded, integrally formed or recessed into one or more of the surfaces of the device.

Accordingly, other embodiments are within the scope of the following claims.

What is claimed is:

1. A folding seat for mounting on a vertical surface comprising:

a frame configured to be mounted on a vertical surface, the frame defining a plane, a plurality of leg members that are pivotably mounted to the frame and are configured to be fully recessed in the plane of the frame when the folding seat is in a closed position, a seat element having a rear edge, at least a portion of the rear edge being pivotably mounted directly to the frame, and a pair of side edges, said at least the portion of each of the rear edge being pivotably mounted to a corresponding one of the leg members.

2. The folding seat of claim 1 further comprising a backrest that is pivotably mounted to a crossbar that connects the leg members.

3. The folding seat of claim 2, wherein the backrest can articulate.

4. The folding seat of claim 2, wherein the backrest is configured with flexible portions.

5. The folding seat of claim 1, wherein the leg elements are pivotably mounted in a middle third of the side edges of the seat element.

6. The folding seat of claim 1, wherein the side edges of the seat element have a middle and the leg elements are pivotably mounted substantially in the middle of the side edges of the seat element.

7. The folding seat of claim 1, wherein the leg members have upper ends that are configured to be vertically slidable with respect to the frame.

8. The folding seat of claim 1, wherein the leg members extend diagonally from the vertical surface to a supporting horizontal surface when deployed.

9. The folding seat of claim 1 further comprising a slide bar that connects the upper ends of the leg members.

10. The folding seat of claim 9, wherein the slide bar is unsupported from below when the device is deployed.

11. The folding seat of claim 1, further comprising a pair of armrests pivotably attached to the seat element.

12. The folding seat of claim 1, wherein the leg members are configured with leveling elements.

13. The folding seat of claim 12, wherein the leveling elements can be fixedly adjusted.

14. The folding seat of claim 1, wherein a wall-mounting bracket is configured to interact with the frame and be securely affixed to the vertical surface.

15. The folding seat of claim 1 further comprising paneling attached to the frame.

16. The folding seat of claim 1 further comprising cover elements that are attached to the frame, seat element, armrests, and leg members.

17. The folding seat of claim 16, wherein the cover elements are configured to substantially mesh together to form a substantially uniform surface that is exposed when the folding seat is in the closed position.

18. The folding seat of claim 1 further comprising a handle configured to allow a user to deploy the folding seat.

19. The folding seat of claim 1, wherein friction hinges are used to pivotably mount the seat element to the frame.

20. A folding seat for mounting on a vertical surface, the folding seat comprising:

a frame configured to be mounted on a vertical surface, a seat element having a rear edge at least a portion of the rear edge being pivotably mounted directly to the frame, and a plurality of leg members that are pivotably mounted to the frame and pivotably mounted to the seat element, wherein the leg members are mounted in a middle third of side edges of the seat element.

21. The folding seat of claim 20 further comprising a backrest that is pivotably mounted to a crossbar which connects the upper ends of the leg members.

22. The folding seat of claim 20, wherein the side edges have a middle and the leg elements are mounted substantially in the middle of the side edges.

23. The folding seat of claim 20, wherein the leg members have upper ends that are configured to be vertically slidable with respect to the frame.

* * * * *